US012209394B2

(12) United States Patent
Sinn et al.

(10) Patent No.: US 12,209,394 B2
(45) Date of Patent: Jan. 28, 2025

(54) ADAPTER RETENTION PLUG

(71) Applicant: Caterpillar Inc., Peoria, IL (US)

(72) Inventors: Eric T. Sinn, Tremont, IL (US); Douglas C. Serrurier, Morton, IL (US); Phillip J. Kunz, Morton, IL (US)

(73) Assignee: Caterpillar Inc., Peoria, IL (US)

( * ) Notice: Subject to any disclaimer, the term of this patent is extended or adjusted under 35 U.S.C. 154(b) by 192 days.

(21) Appl. No.: 17/673,027

(22) Filed: Feb. 16, 2022

(65) Prior Publication Data

US 2023/0257969 A1 Aug. 17, 2023

(51) Int. Cl.
*E02F 9/28* (2006.01)

(52) U.S. Cl.
CPC ..... *E02F 9/2825* (2013.01); *E02F 9/2833* (2013.01); *E02F 9/2883* (2013.01); *E02F 9/28* (2013.01)

(58) Field of Classification Search
CPC ..... E02F 9/2825; E02F 9/2808; E02F 9/2816; E02F 9/26; E02F 9/28; E02F 9/2841; E02F 9/2833; E02F 9/2883; B65G 57/02; B65G 57/03; B65G 57/165
USPC ..... 414/788, 788.2, 788.9
See application file for complete search history.

(56) References Cited

U.S. PATENT DOCUMENTS 4,231,173 A * 11/1980 Davis ..... E02F 9/2833 37/457
5,063,695 A * 11/1991 Briscoe ..... E02F 9/28 403/381
5,666,748 A * 9/1997 Emrich ..... E02F 9/2883 403/374.1
7,299,570 B2 11/2007 Emrich et al.
9,315,972 B2 4/2016 Anisy et al.
10,100,498 B2 10/2018 Attwood et al.
10,190,290 B2 * 1/2019 Gandy ..... E02F 9/2841
2013/0269222 A1 10/2013 Knight
2014/0082976 A1 * 3/2014 Vicq ..... E02F 9/2825 37/453
2016/0047110 A1 * 2/2016 Hand ..... E02F 9/2825 37/458
2016/0097171 A1 * 4/2016 Rogers ..... E01F 9/692 414/801
2016/0237657 A1 * 8/2016 Carpenter ..... E02F 9/2833
2016/0305095 A1 10/2016 Kunz
2016/0356024 A1 * 12/2016 Gandy ..... E02F 9/2841
2017/0101622 A1 * 4/2017 Ahlfors ..... A61K 35/30

FOREIGN PATENT DOCUMENTS

| | | |
|---|---|---|
| AU | 698333 | 10/1998 |
| CN | 207032362 U | 2/2018 |
| EP | 2644786 | 7/2017 |
| EP | 2898150 | 5/2019 |
| WO | 2012068643 | 5/2012 |

* cited by examiner

*Primary Examiner* — Jamie L McGowan
*Assistant Examiner* — Audrey L Lusk

(57) ABSTRACT

An adapter retention plug includes an elongated body defining a right extremity, and a left extremity disposed along a longitudinal axis. The elongated body also includes a right vertical undercut forming void, a left vertical undercut forming void, and a tab extending along the longitudinal axis defining the right extremity.

16 Claims, 15 Drawing Sheets

ADAPTER RETENTION PLUG

TECHNICAL FIELD

The present disclosure relates generally to a retaining mechanism used to attach wear member assemblies including an adapter or the like to an edge of a work tool, and more particularly, to such assemblies that employ plugs to help prevent the ingress of mud, dirt, debris, etc. in the retaining mechanism.

BACKGROUND

Many earth-working machines, such as, for example, loaders, excavators, hydraulic mining shovels, cable shovels, bucket wheels, and draglines, include tools for moving material (e.g., for digging material out of the earth). These tools are often subjected to extreme wear from abrasion and impacts experienced while moving the material. In order to mitigate the wear, replaceable wear members are fit to the tools and engage the material being moved. To facilitate the attachment of the wear members, adapters are often removably attached to the work tool using a retaining mechanism that is placed into a pocket or aperture of the adapter and/or the work tool. The ingress of mud, dirt, debris, etc. overtime may lead to problems accessing the retaining mechanism for periodic maintenance such as replacing the adapter, etc. For example, FIGS. 2 and 3 illustrate that the retaining mechanism 300 may be exposed in current designs, creating the aforementioned problems with access and maintenance.

One proposed solution is disclosed by U.S. Pat. No. 10,190,290 B2. The lock assembly comprises first and second bodies that are configured to be assembled together. One body is substantially positioned over the other in an assembled condition to form a lock extending along a longitudinal axis. The first and second bodies each comprise at least one inter-engaging formation on the bodies that are configured in the assembled condition to form one or more couplings that resist lateral displacement of the bodies with respect to each other under loads applied transverse to the longitudinal axis of the assembled lock to the side of the first and second bodies. A plug that is formed of an elastomeric material is provided that is shaped to provide a seal against the ingress of fines into the cavity in which the locking bodies are located.

However, such a plug is prone to damage and may fall out of the cavity unintentionally. So, a more robust system is warranted.

SUMMARY OF THE DISCLOSURE

An adapter retention plug according to an embodiment of the present disclosure may comprise an elongated body defining a right extremity, and a left extremity disposed along a longitudinal axis. The elongated body may include a right vertical undercut forming void, a left vertical undercut forming void, and a tab extending along the longitudinal axis defining the right extremity.

An adapter retention plug according to another embodiment of the present disclosure may comprise an elongated body defining a right extremity, and a left extremity disposed along a longitudinal axis. The elongated body may include at least a first vertical undercut forming void, a tab extending axially defining the right extremity, and at least one L-shaped projection that is configured to at least complementarily fit into the at least first vertical undercut forming void.

A retaining mechanism according to an embodiment of the present disclosure may comprise a wedge defining a fastener and slider receiving aperture, a slider that is configured to fit into the fastener and slider receiving aperture, a first fastener that is configured to fit in the fastener and slider receiving aperture of the wedge, and a first adapter retention plug that includes a slot having a first stop surface, a top surface, and a second stop surface that is oblique to the first stop surface.

BRIEF DESCRIPTION OF THE DRAWINGS

The accompanying drawings, which are incorporated in and constitute a part of this specification, illustrate several embodiments of the disclosure and together with the description, serve to explain the principles of the disclosure. In the drawings.

DETAILED DESCRIPTION

Figure 1:
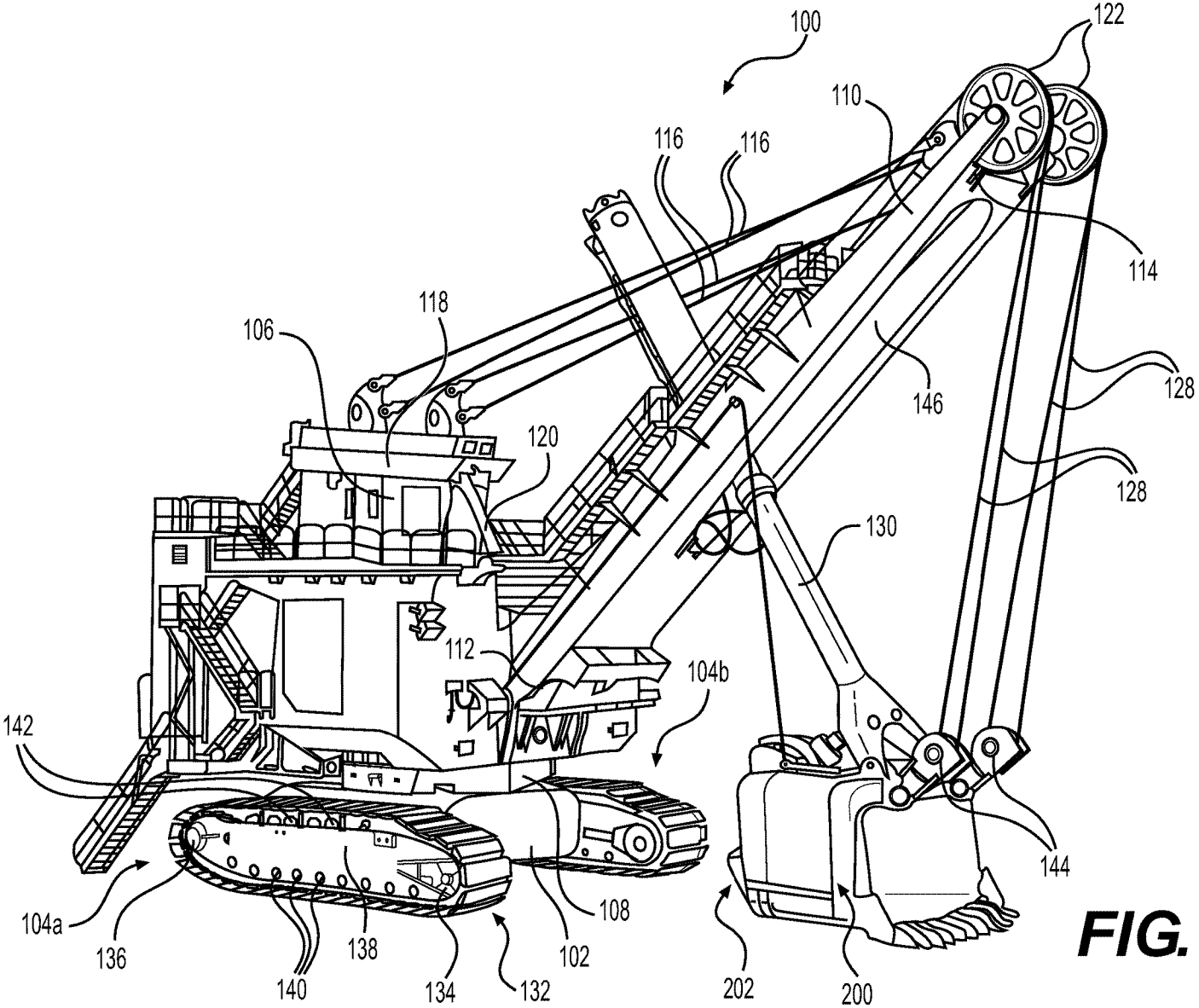
FIG. 1 illustrates a machine that may use a work tool such a dipper having wear members, retaining mechanism(s), and adapter retention plug(s) configured according to various embodiments of the present disclosure.

Reference will now be made in detail to embodiments of the disclosure, examples of which are illustrated in the accompanying drawings. Wherever possible, the same reference numbers will be used throughout the drawings to refer to the same or like parts. In some cases, a reference number will be indicated in this specification and the drawings will show the reference number followed by a letter for example, 100*a*, 100*b* etc. It is to be understood that the use of letters immediately after a reference number indicates that these features are similarly shaped and have similar function as is often the case when geometry is mirrored about a plane of symmetry. For ease of explanation in this specification, letters will often not be included herein but may be shown in the drawings to indicate duplications of features discussed within this written specification Starting with FIGS. 1 and 2, there is shown a machine 100 (e.g., an electric rope shovel with a dipper that may use any of the embodiments discussed herein) having a carbody 102 (which may include a turntable 108) with a track system including a first track chain 104*a* and a second track chain 104*b* positioned at opposite sides of carbody 102. Machine 100 is shown in the context of an electric rope shovel having an operator cab 106, a boom 110, a lower end 112 of the boom 110 (also called a boom foot), an upper end 114 of the boom 110 (also called a boom point), tension cables 116, a gantry tension member 118, a gantry compression member 120, a sheave 122 rotatably mounted on the upper end 114 of the boom 110, a dipper 200, a dipper door 202 pivotally coupled to the dipper 200, a hoist rope 128, a winch drum (not shown), and a dipper handle 130. An electric motor controls the winch drum, causing the lowering or raising of the boom, dipper, and upward and downward movement of the dipper handle relative to the boom.

Tracks 104*a* and 104*b* are part of a machine undercarriage 132 coupled with carbody 102 in a conventional manner. Each of tracks 104*a* and 104*b* include a plurality of coupled together track shoes forming endless loops extending about a plurality of rotatable elements. In a typical design, an idler 134 and a drive sprocket 136 will be associated with each of tracks 104*a* and 104*b* and mounted to a track roller frame 138. A plurality of track rollers 140 may also be mounted to roller frame 138, and are associated with each of tracks 104*a* and 104*b* to support machine 100 and guide tracks 104*a* and 104*b* in desired paths, as further described herein. One or more carrier rollers 142 (or track sliders) may also be associated with each of tracks 104*a* and 104*b* to support and guide the tracks opposite rollers 240 during operation.

The unique design of tracks 104*a* and 104*b* and the overall track and undercarriage system of which they are a part are contemplated to enable machine 100 to operate in certain environments such as oilsands. While use in the machine environment of an electric roper shovel and dipper is emphasized herein, it should be understood that machine 100 might comprise a different type of machine. For instance, track-type tractors or even half-track machines are contemplated herein. Further still, machine 100 might consist of a conveyor or other type of machine wherein tracks are used for purposes other than as ground engaging elements. Also, the machine might be some type of hydraulic shovel, bulldozer, excavator, back hoe, etc.

The dipper 200 is suspended from the boom 110 by the hoist rope 128. The hoist rope 128 is wrapped over the sheave 122 and attached to the dipper 200 at a bail 144. The hoist rope 128 is anchored to the winch drum (not shown). The winch drum is driven by at least one electric motor (not shown) that incorporates a transmission unit (not shown). As the winch drum rotates, the hoist rope 128 is paid out to lower the dipper 200 or pulled in to raise the dipper 200. The dipper handle 130 is also coupled to the dipper 200. The dipper handle 130 is slidably supported in the saddle block 146, and the saddle block 146 is pivotally mounted to the boom 110 at the shipper shaft (not clearly shown). The dipper handle 130 includes a rack and tooth formation thereon that engages a drive pinion (not shown) mounted in the saddle block 146. The drive pinion is driven by an electric motor and transmission unit (not shown) to extend or retract the dipper handle 130 relative to the saddle block 146.

An electrical power source (not shown) is mounted to the carbody 102 to provide power to a hoist electric motor (not shown) for driving the hoist drum, one or more crowd electric motors (not shown) for driving the crowd transmission unit, and one or more swing electric motors (not shown) for turning the turntable 208. In some cases, one electric motor powers all of the moving components of the shovel. Each of the crowd, hoist, and swing motors is driven by its own motor controller, or is alternatively driven in response to control signals from a controller (not clearly shown).

The track chains 104*a* and 104*b* are considered to be well suited for work in hard underfoot conditions. To this end, the track chains 104*a* and 104*b* may be "high ground pressure" tracks, each having track members durable enough to support a relatively large weight of machine 100. Each of track shoe members has a footprint defined in part by front and back edges, and also defined in part by outboard edges and inboard edges. Each of track shoe members may further include a ground contact area that is equal to its footprint, or less than its footprint only to an extent that adjacent track shoes overlap one another or due to voids disposed on the bottom surface of the track shoe member. Other configurations of the track shoes and track chain assemblies are possible in other embodiments of the present disclosure.

Figure 2:
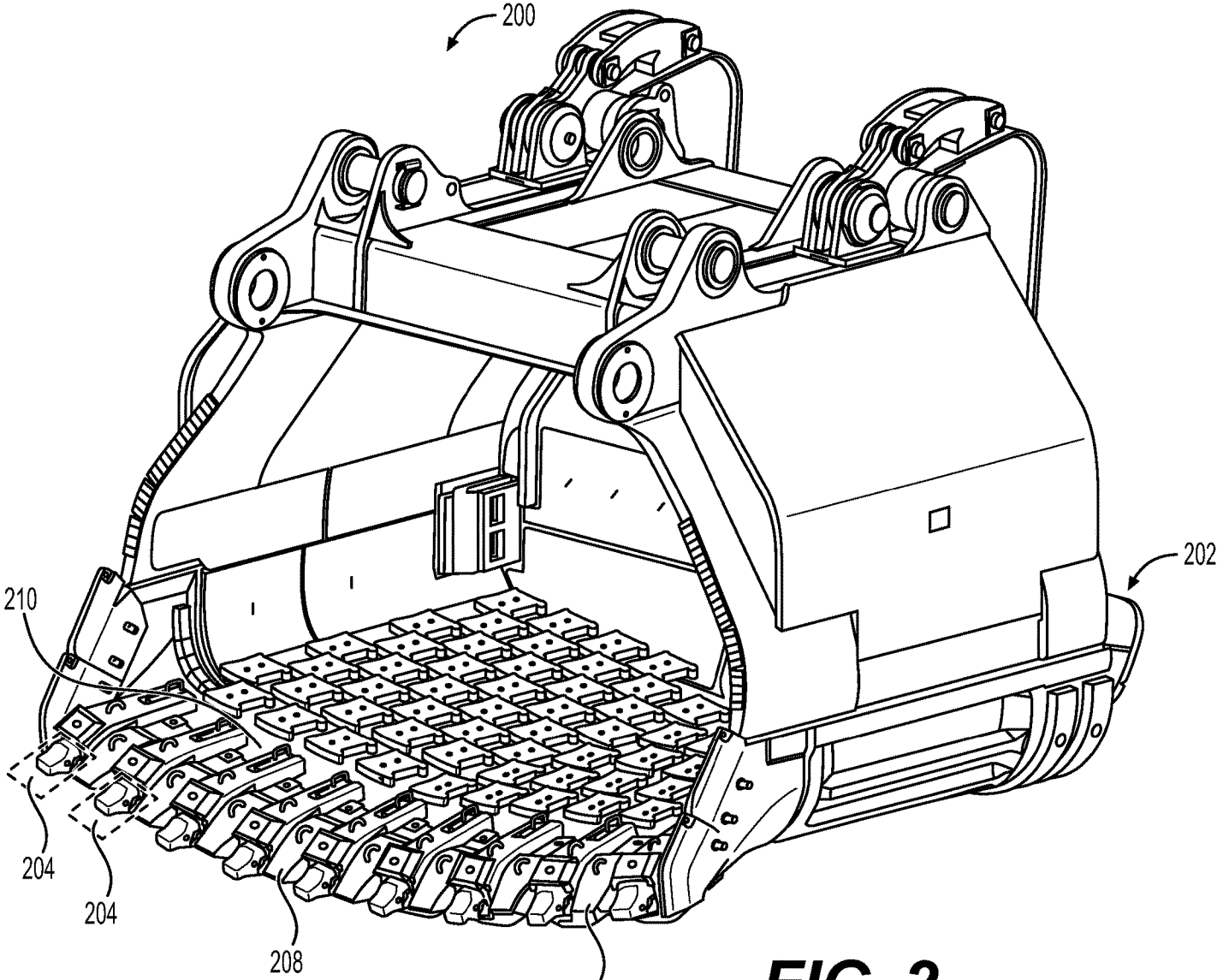
FIG. 2 is a perspective view of work tool in the form of a that may be used by the machine of FIG. 1 shown in isolation.
Figure 3:
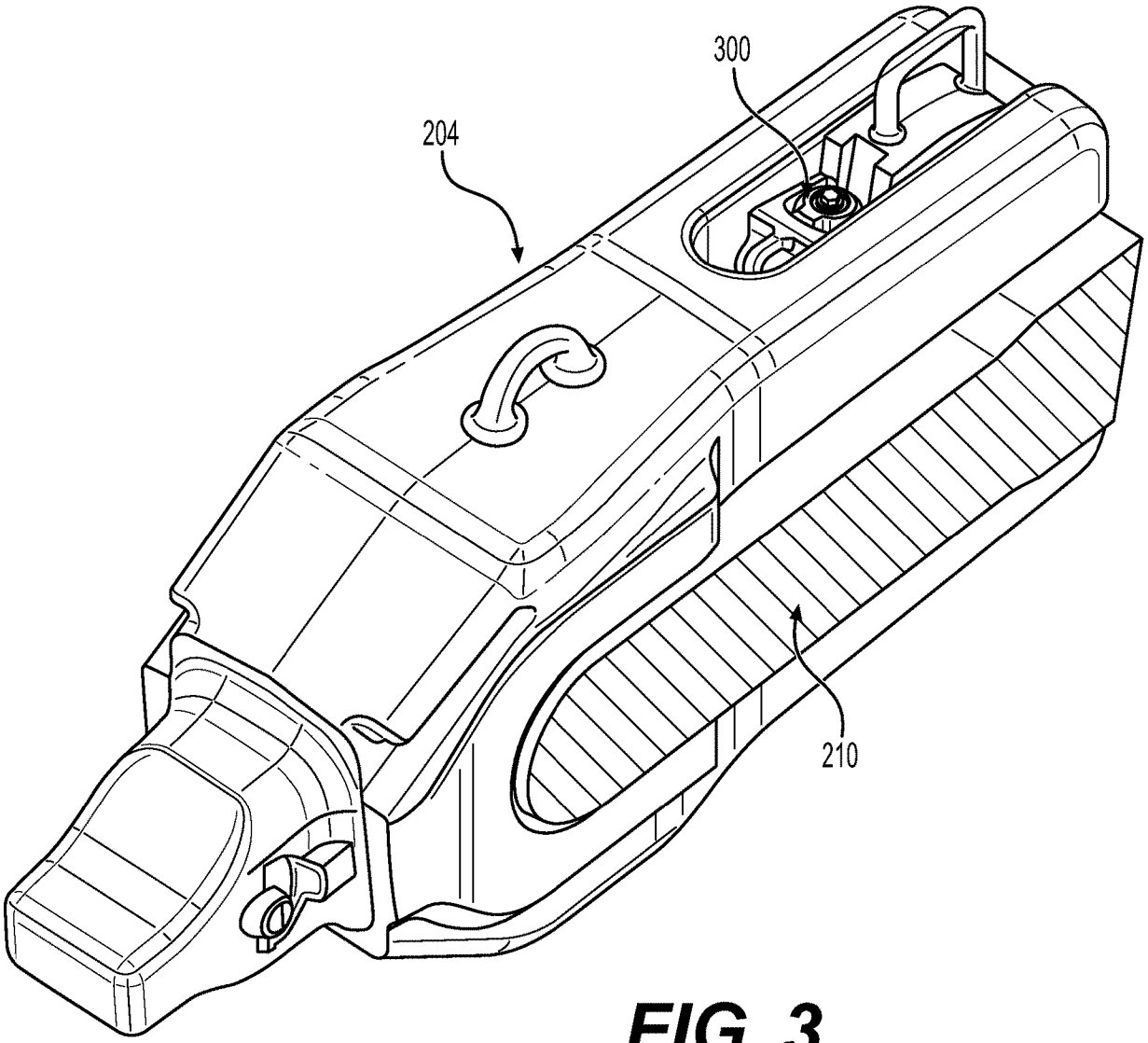
FIG. 3 PRIOR ART
FIG. 3 is partial sectional view of an assembly having a front lip a dipper similar to that of FIG. 2, except that no adapter retention plug is provided as is known in the prior art to keep debris, mud, etc. away from the retaining mechanism used to attach the adapter to the front lip.
Figure 4:
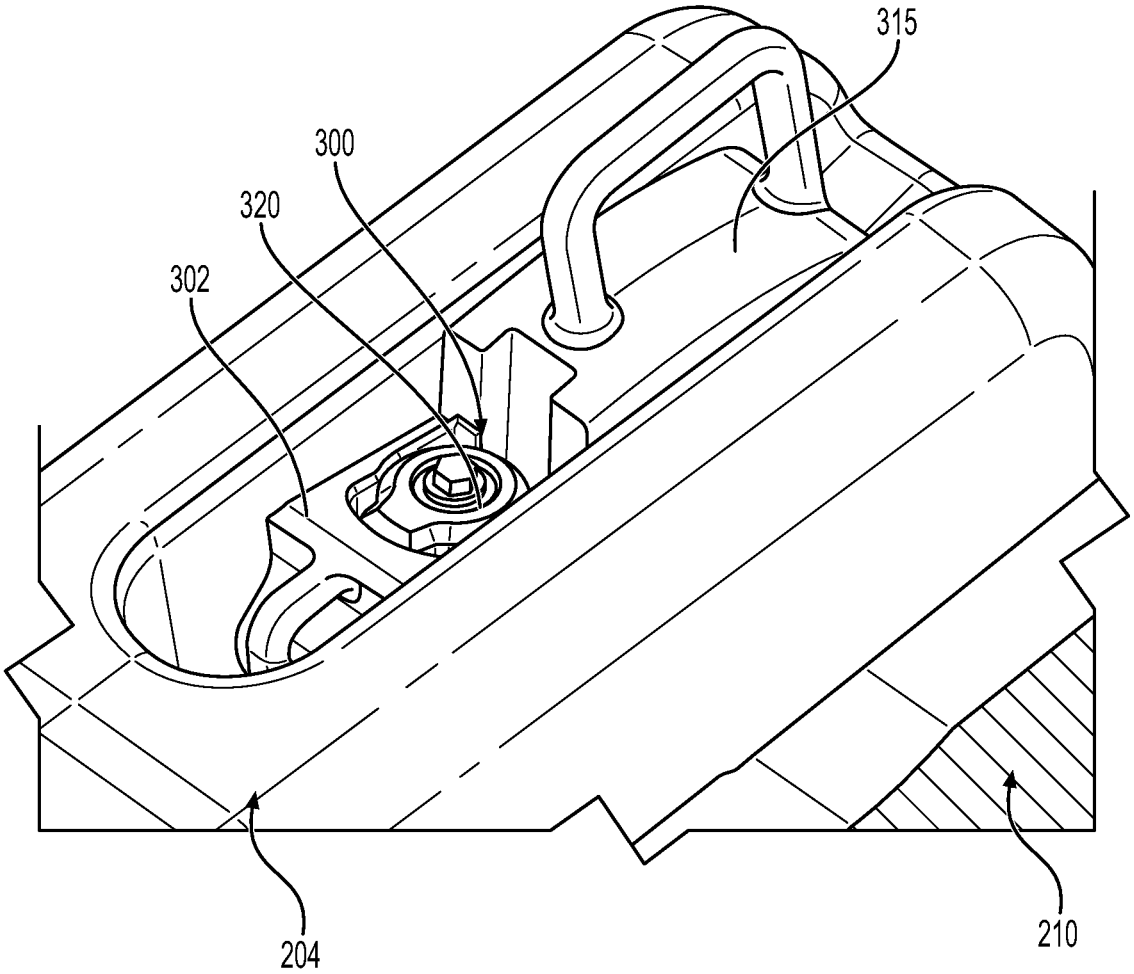
FIG. 4 PRIOR ART
FIG. 4 is an enlarged detail view showing the exposed retaining mechanism of assembly FIG. 3 more clearly.
Figure 5:
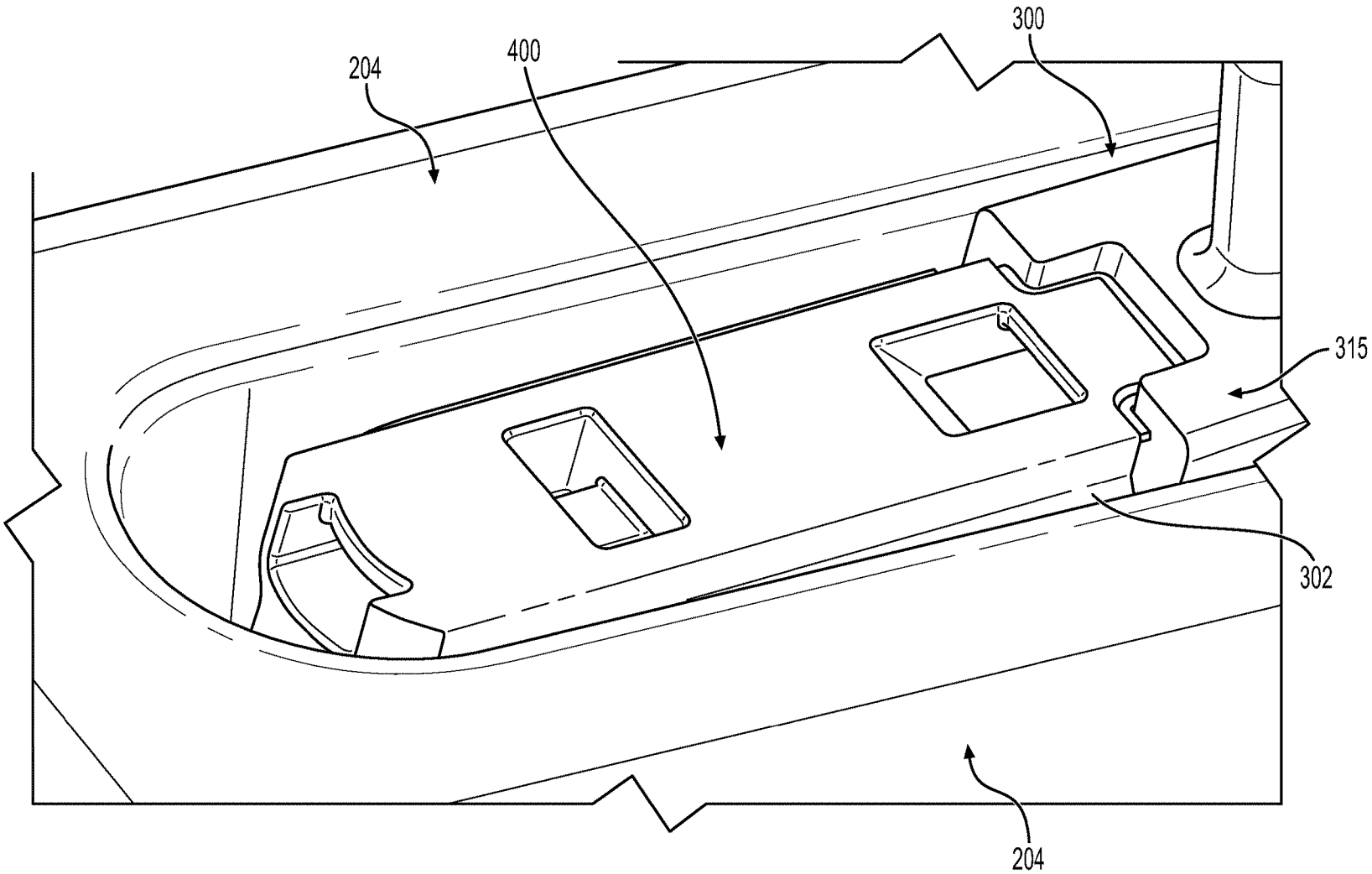
FIG. 5 is similar to FIG. 4 except that the assembly has one or more adapter retention plugs configured according to an embodiment of the present disclosure that is/are employed to cover the retaining mechanism, helping to prevent the infiltration of debris, mud, etc.

As shown best in FIG. 2, the dipper may have a plurality of tips 204, adapters 206, and shrouds 208 that are attached to its front lip 210. Focusing on FIGS. 6, 7, and 8, the retaining mechanism 300 may be described as follow with reference to U.S. Pat. No. 9,957,696 B2. The retaining mechanism 300 may include a wedge 302 defining a fastener and slider receiving aperture 304, a slider 306 that is configured to fit into the fastener and slider receiving aperture 304, and a first fastener 308 (may take the form of a cap screw or the like) that is configured to fit in the fastener and slider receiving aperture 304 of the wedge 302. Also, a first adapter retention plug 400*a* that includes a slot 402 having a first stop surface 404 (may face toward the right), a top slot surface 406, and a second stop surface 408 that is oblique to the first stop surface 404 (may also face toward the left). More specifically, the first stop surface 404 may be vertical (i.e., within 7.0 degrees of vertical to accommodate a draft angle), while the top slot surface 406 may be horizontal.

Figure 6:
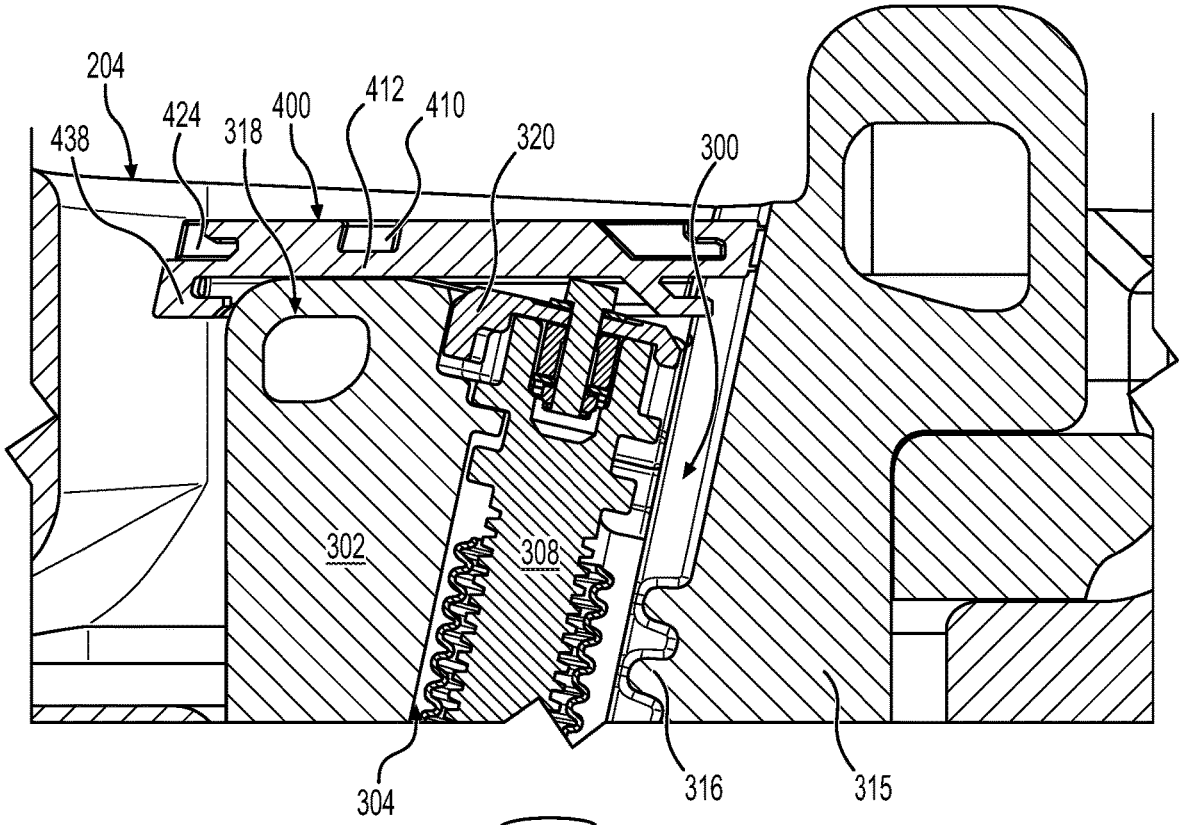
FIG. 6 is a sectional view of the assembly of FIG. 5 taken along lines 6-6 thereof. The assembly is shown before wear has occurred such that the retaining mechanism is near the top of the adapter, only requiring a single adapter retention plug initially.
Figure 6:
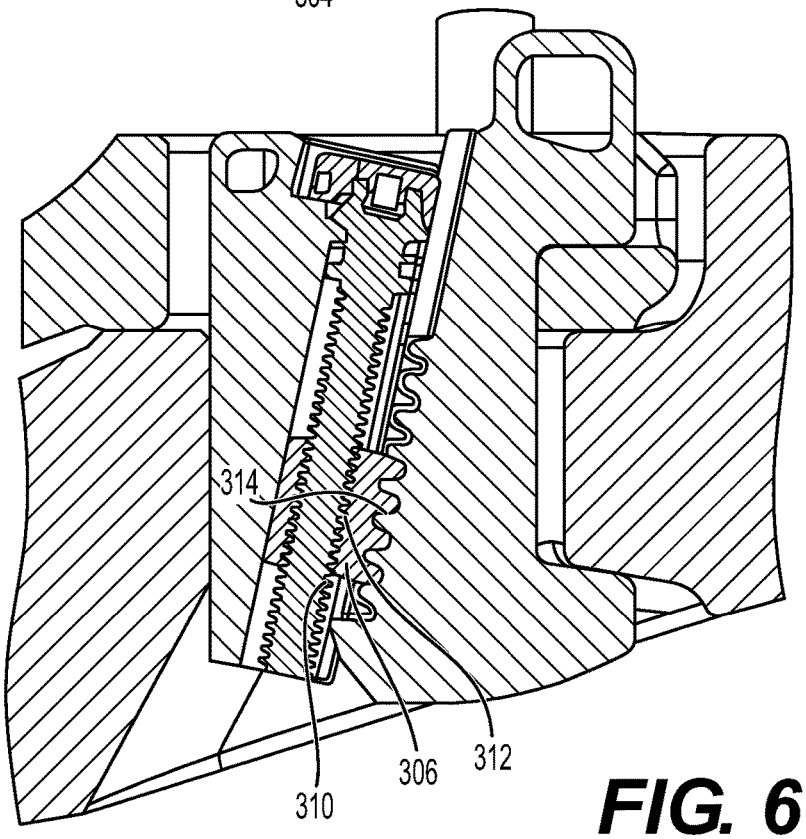
Figure 7:
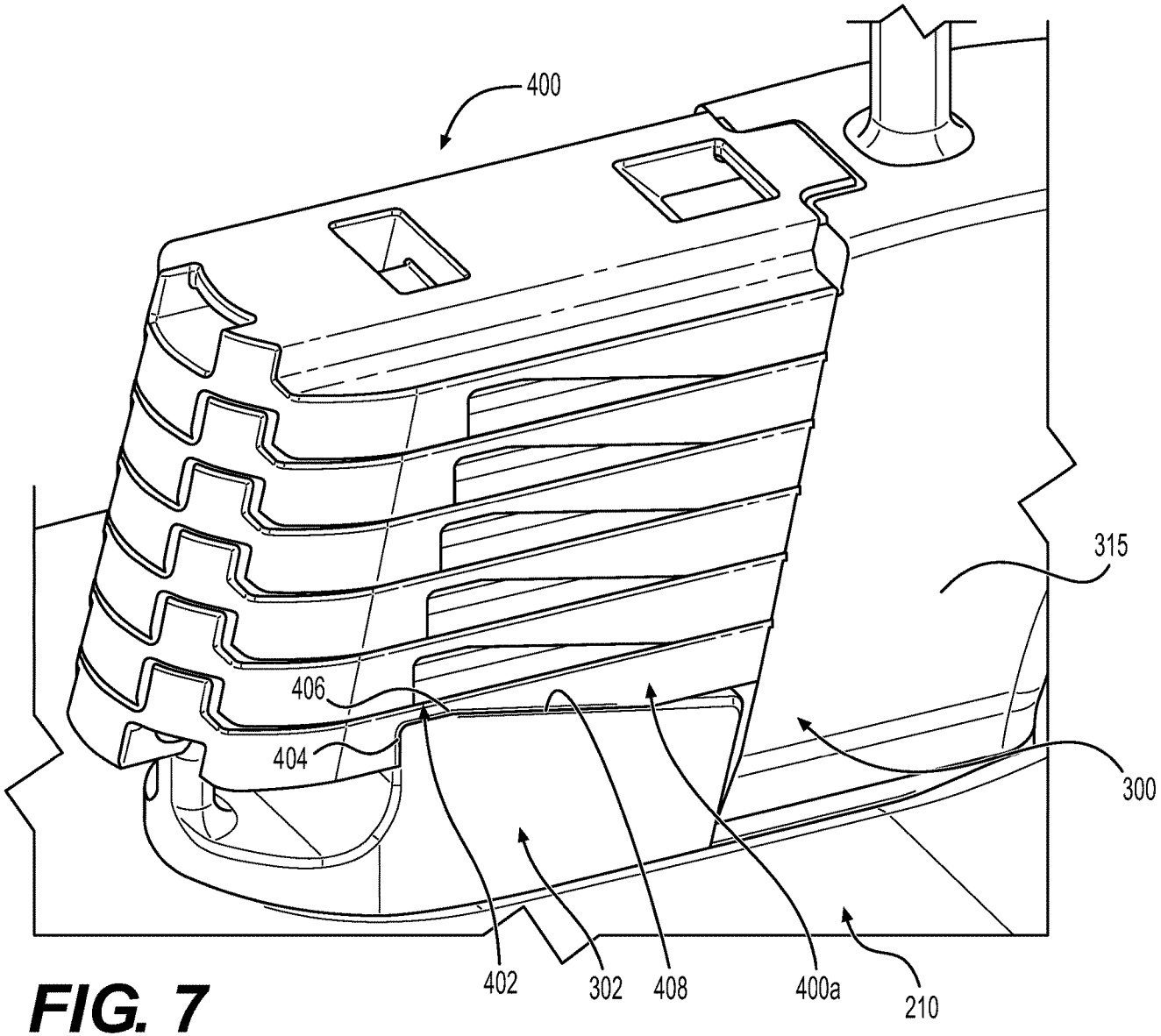
FIG. 7 shows an assembly similar to that of FIG. 6 except that the adapter is removed for enhanced clarity, and a plurality of adapter retention plugs are shown to be employed after wear of the retaining mechanism has occurred.

In addition as best seen in FIG. 6, the first fastener 308 may include external threads 310, while the slider 306 includes internal threads 312 that mate with the external threads of the first fastener 308. Moreover, the slider 306 has external ridges 314 that mate with a clamp 315 that includes angled ridges 316 that engage the external ridges of the of the slider 306. As a result of this construction, rotation of the first fastener causes it and the wedge to move upward or downward, and axially away or toward the clamp, allowing locking or unlocking of the adapter to the front lip of the dipper.

Figure 8:
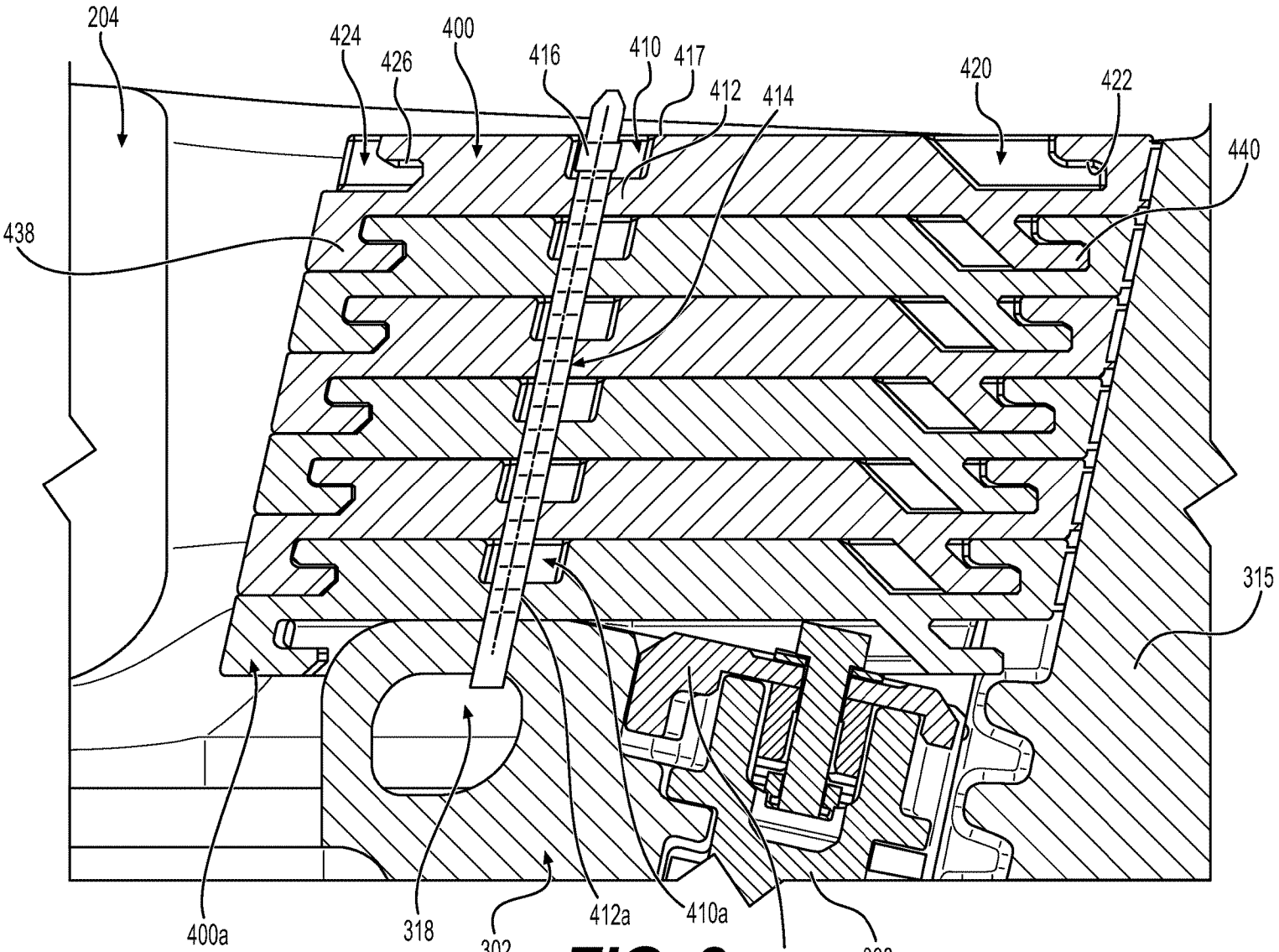
FIG. 8. shows the assembly of FIG. 7 shown in cross-section with the adapter also shown as well as a fastener that connects the plurality of adapter retention plugs to a lifting eye of the retaining mechanism.

Looking at FIGS. 6 and 8 together, the wedge 302 may include a lifting eye 318, and an adapter retention plug 400 may include a first fastener receiving aperture 410 with a first strut 412 that is disposed vertically above the lifting eye 318. A second fastener 414 that is provided that is configured to engage the lifting eye 318, and the first 412 strut.

As best seen in FIG. 8, the second fastener 414 may take the form of a zip tie (e.g., may be made from plastic, stainless steel, etc.) or may take other forms such as wire, clips, etc. The retaining mechanism 300 may also include another adapter retention plug 400*a* that is identically that is configured to the first adapter retention plug 400 including a second fastener receiving aperture 410*a* with a second strut 412*a* that is disposed vertically in line with the first strut, contacting the first adapter retention plug (directly or indirectly), As shown, the zip tie includes a head 416 that sits in the aperture that acts like a counterbore 417 to protect the head 416 of the zip tie. This may not be the case in other embodiments of the present disclosure. Also, only the top and bottom adapter retention plugs may have the struts, etc.

Focusing now on FIGS. 11 thru 15, an adapter retention plug 400 that may be provided as a retrofit or replacement part will now be described as follows. The adapter retention plug 400 may comprise an elongated body (so called since it defines a longitudinal axis 418 defining its greatest extent) defining a right extremity 419 axially (i.e., along axis 418), and a left extremity 421 disposed along the longitudinal axis 418. The elongated body may include a right vertical undercut forming void 420 as formed by a right ledge 422 (best seen in FIG. 8), as well as a left vertical undercut forming void 424 as formed by a left ledge 426. Also, a tab 428 may extend along the longitudinal axis 418 defining the right extremity 419.

More particularly, the left vertical undercut forming void 424 may extend from the left extremity 421, while the right vertical undercut forming void 420 may be disposed axially between the tab 428, and the left vertical undercut forming void 424. As alluded to earlier herein, the elongated body may further define a fastener receiving aperture 410 that includes a strut 412 that splits the fastener receiving aperture 410 into a front slot 430 and a rear slot 432. In addition, the elongated body may include a top surface 434, a bottom surface 436, and the strut 412 may extend from the bottom surface 436 (e.g., may be coplanar) but terminates short of the top surface 434, thereby forming a possible counterbore 417 to protect the head of the zip tie as mentioned earlier herein.

Furthermore, the elongated body may include a left L-shaped projection 438 extending from the bottom surface 436. The left L-shaped projection 438 may be at least partially complementarily shaped to the left vertical undercut forming void 424 (or completely complementarily shaped as shown since the void is at the left extremity). Other configurations are possible in other embodiments of the present disclosure.

Figure 9:
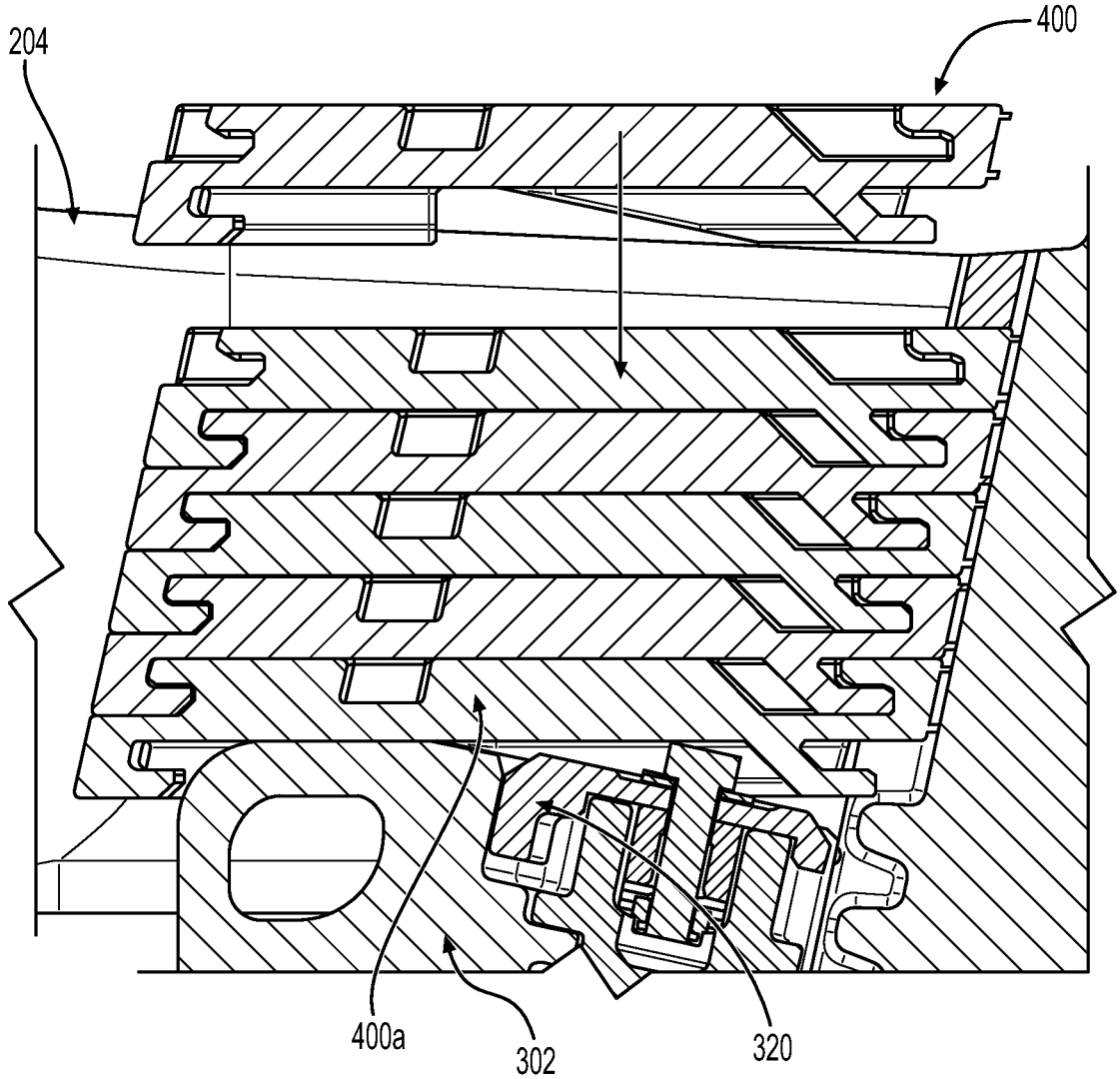
FIG. 9 illustrates one of the adapter retention plugs of FIG. 8 being lowered onto another of the adapter retention plugs.
Figure 10:
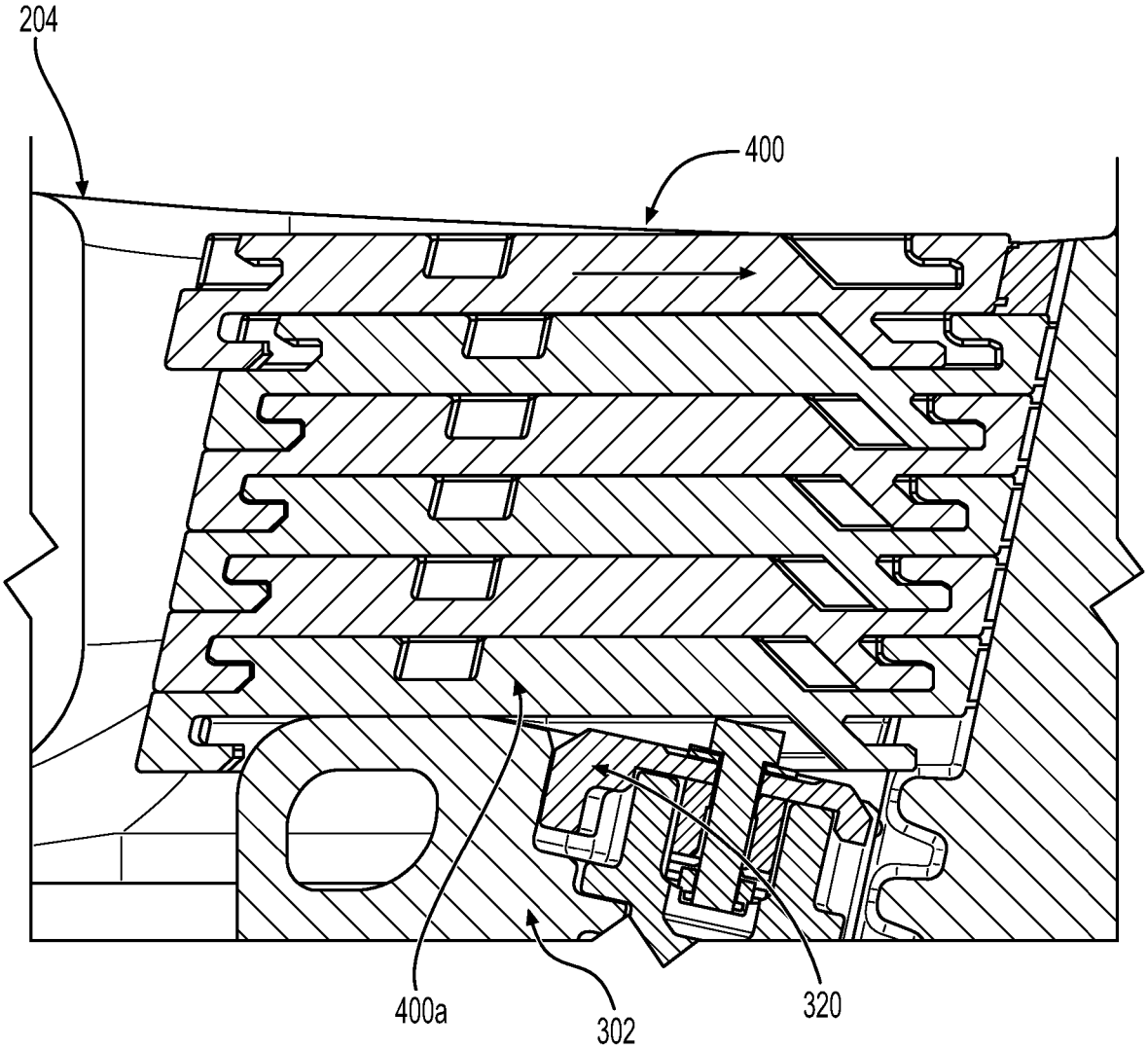
FIG. 10 illustrates the top adapter retention plug of FIG. 9 being slid to the right (horizontally), locking it to the adapter retention plug disposed beneath it.
Figure 11:
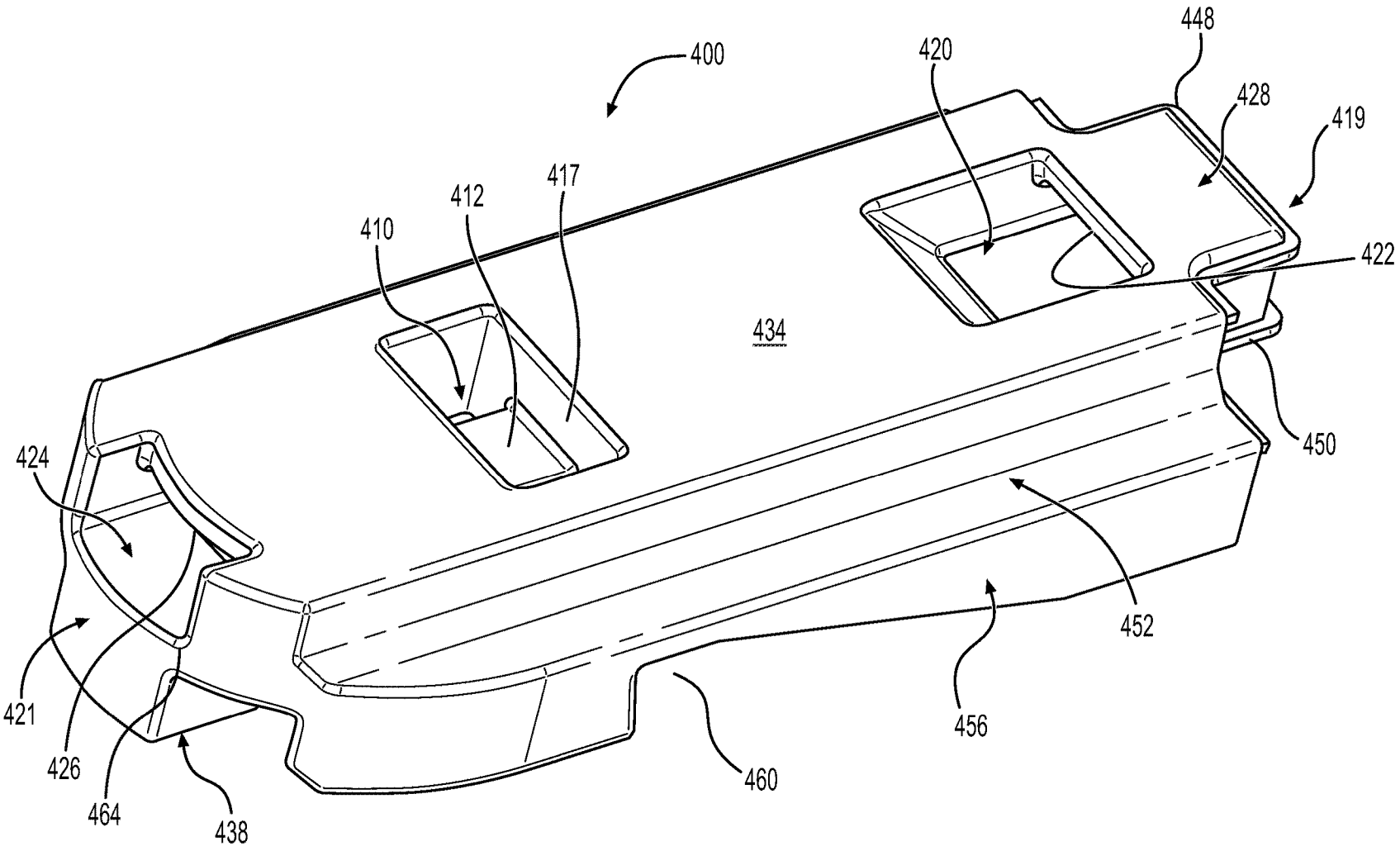
FIG. 11 is a top oriented perspective view of an adapter retention plug such as shown in FIGS. 5 thru 10, shown in isolation.
Figure 12:
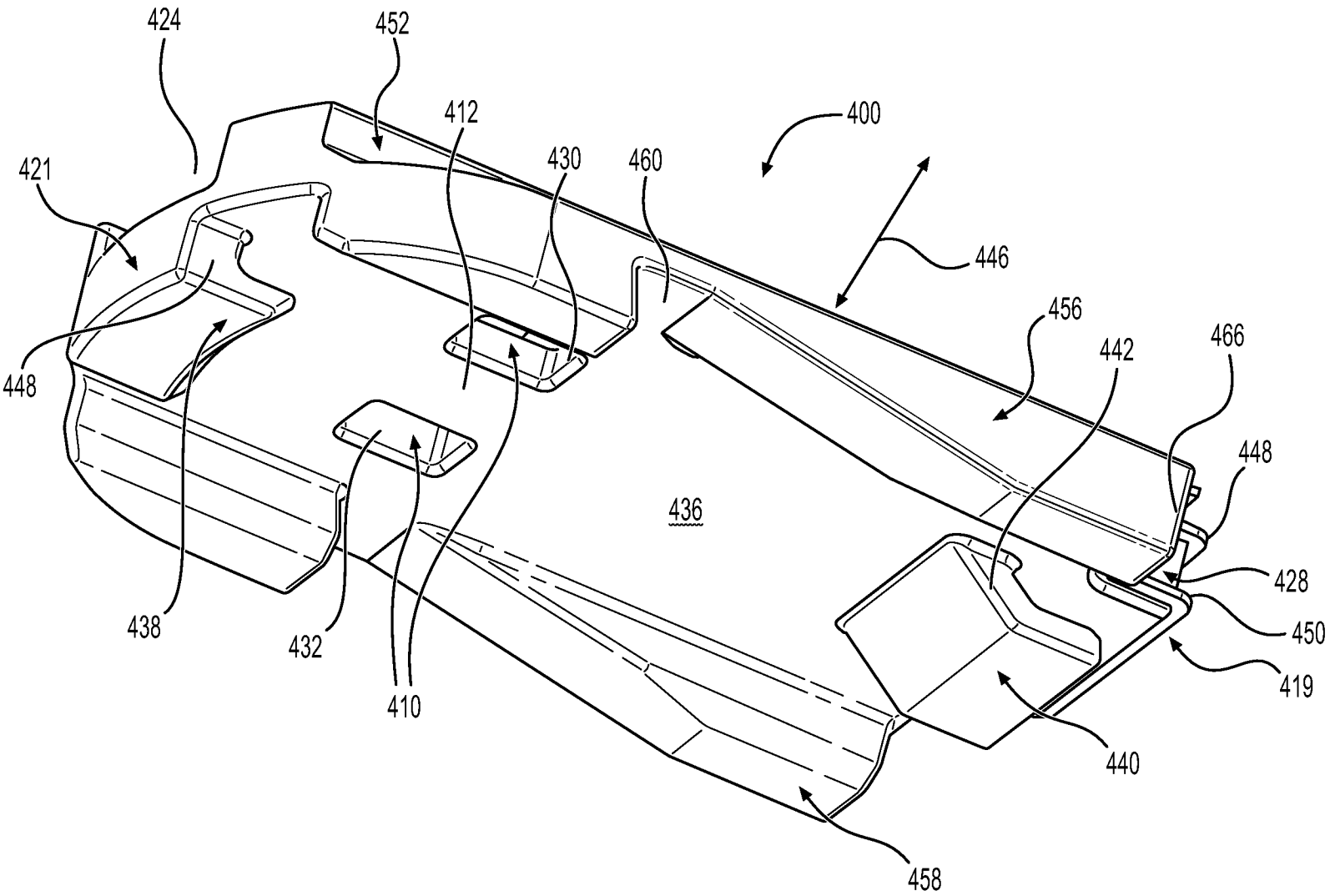
FIG. 12 is a bottom oriented perspective view of the adapter retention plug of FIG. 11.
Figure 13:
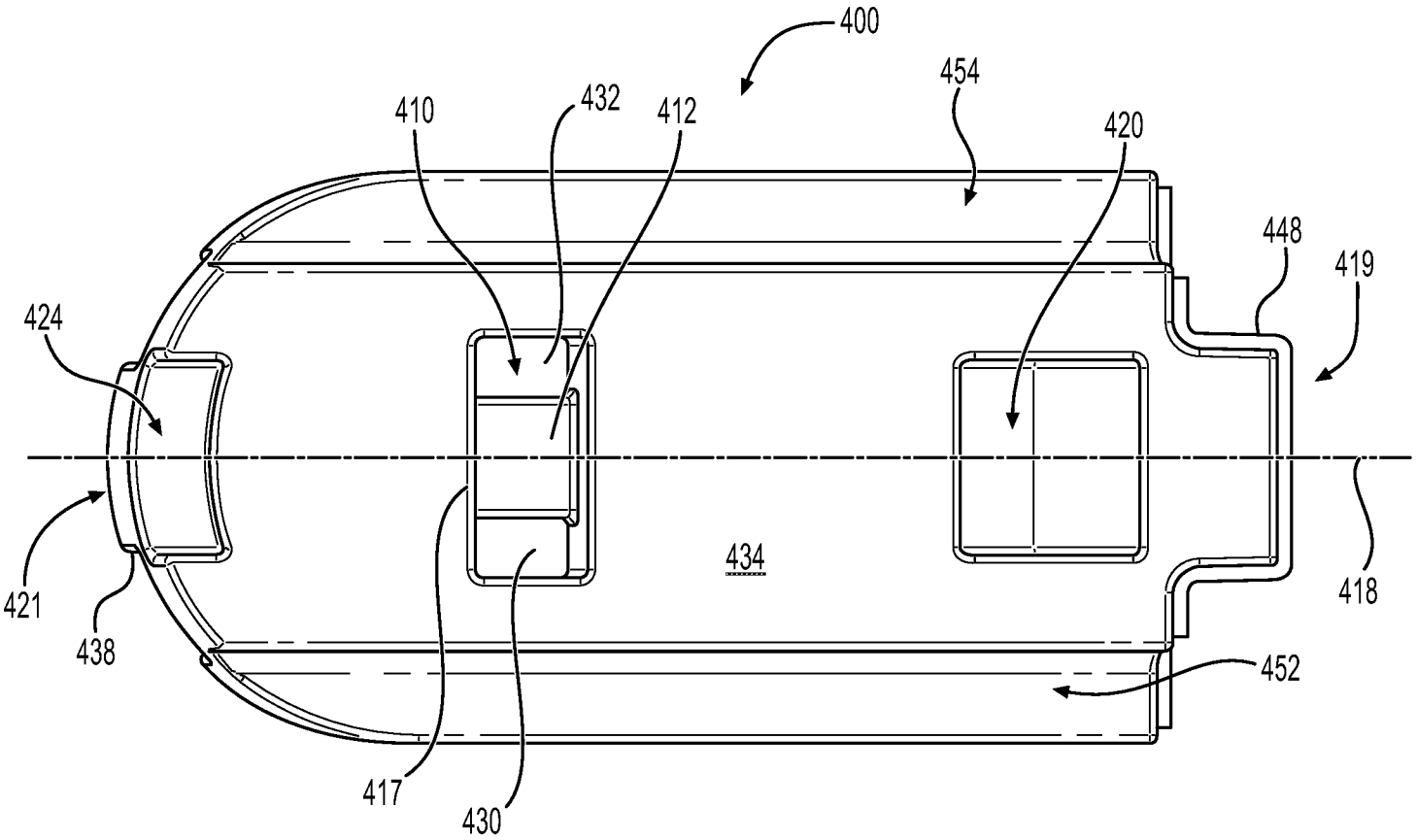
FIG. 13 is a top view of the adapter retention plug of FIG. 11.
Figure 14:
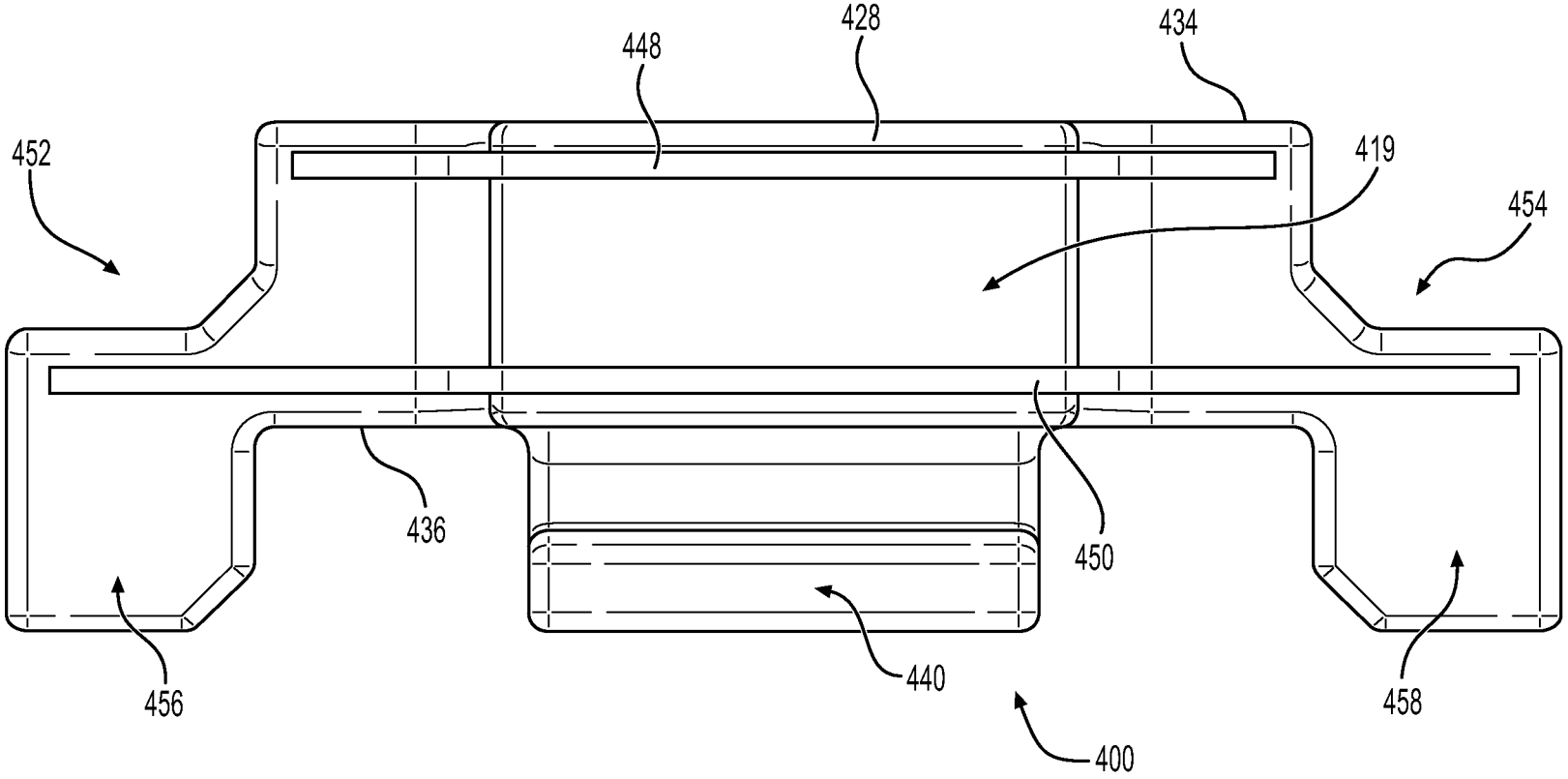
FIG. 14 is a right view of the adapter retention plug of FIG. 11.

Similarly, a right L-shaped projection 440 may also extend from the bottom surface 436 that is at least partially complementarily shaped to the right vertical undercut forming void 420. As shown, this projection 440 may also be axially (i.e., along longitudinal axis 418) undersized compared to the right vertical undercut forming void 420. This allows the projection 440 to slide vertically down into the void and then slide right to lock vertically adjacent plugs together as represented by FIGS. 9 and 10.

Both the right L-shaped projection 440, and the left L-shaped projection 438 includes a right angled vertical member 442, and a left vertical member 444 respectively. The right angled vertical member 442 may be angled more relative to the vertical direction 446 (see FIG. 12, e.g., about 30.0 to 50.0 degrees, or about 40.0 degrees) than the left vertical member 448 (e.g., less than 20.0 degrees, or about 10.0 to about 15.0 degrees). This may not the case in other embodiments of the present disclosure.

As best seen in FIGS. 11 thru 15, the elongated body may include a top rib 448, and a bottom rib 450 that extend from the tab 428. These ribs may be omitted in other embodiments of the present disclosure. Also, the elongated body may define a front groove 452 that extends vertically from the top surface 434, and axially from the left extremity 421 to the right extremity 419. Symmetrically, a rear groove 454 that extends vertically from the top surface 434, and axially from the left extremity 421 to the right extremity 419. A front rail 456 or a rear rail 458 extends from the bottom surface 436 that are configured to fit with the aforementioned slots 452, 454. The front rail or the rear rail may also include a pry slot 460 including an angled pry surface 462 that may help the assembly or disassembly of one plug from an adjacent vertical plug. Alternatively, the right vertical undercut forming void 420 may be used as a pry slot, etc.

Figure 15:
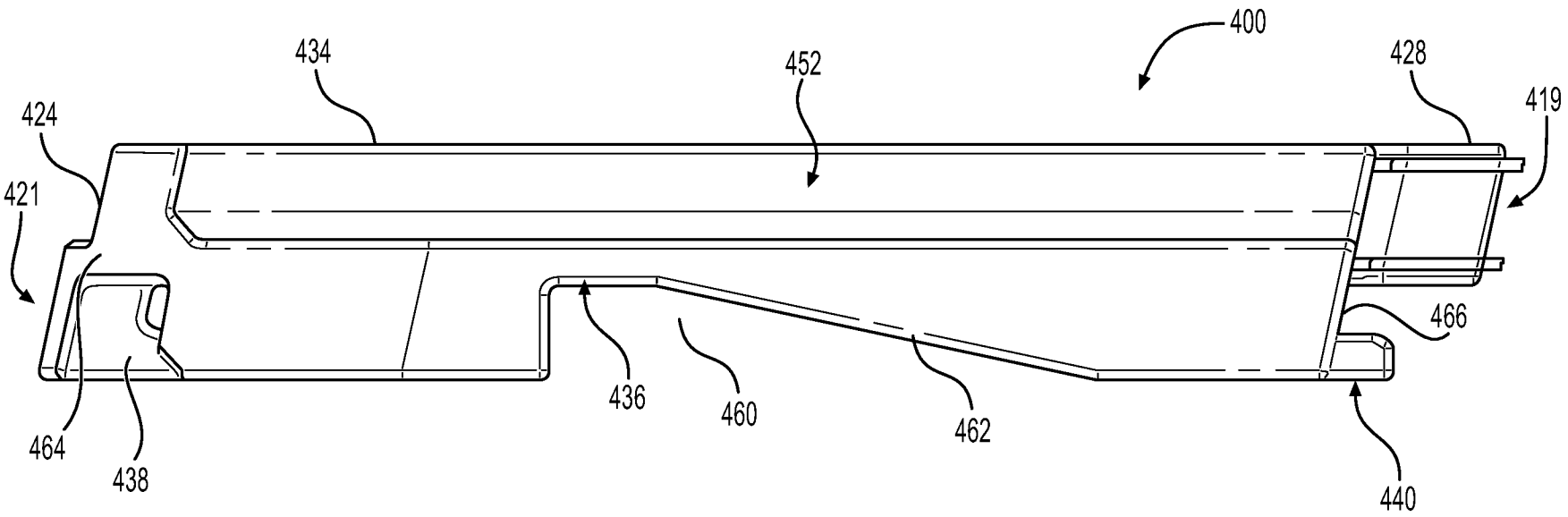
FIG. 15 is a front view of the adapter retention plug of FIG. 11.

Moreover, the elongated body may include a convex arcuate surface 464 that forms the left extremity 421, and that is drafted to enlarge axially from the top surface 434 toward the bottom surface 436. On the other hand, the elongated body ma include a planar surface 466 that is disposed proximate to the right extremity 419, and that is drafted to decrease axially from the top surface 434 toward the bottom surface 436. In FIG. 15, the draft angles of these surfaces 464, 466 are parallel. This may not be the case in other embodiments of the present disclosure.

Alternatively, an adapter retention plug 400 according to another embodiment of the present disclosure may comprise an elongated body as previously described herein with reference to FIGS. 11 thru 15, defining a right extremity 419, and a left extremity 421 disposed along the longitudinal axis 418. At least a first vertical undercut forming void (may take the form of the right vertical undercut forming void 420, and/or the left vertical undercut forming void 424) is provided, as well as a tab 428 extending axially, defining the right extremity 419. In addition, at least one L-shaped projection (may take the form of the left L-shaped projection 438, and/or the right L-shaped projection 440) that is configured to at least complementarily fit into the at least first vertical undercut forming void may be provided.

As also previously alluded to herein, a fastener receiving aperture 410, 410*a* may be provided with a strut 412, 412*a* disposed in the fastener receiving aperture for engaging a fastener such as a zip tie (e.g., see 414) or the like. When two voids 420 and 424 are provided, then the fastener receiving aperture 412, 412*a* may be disposed axially between the first and the second vertical undercut forming voids. This may not be the case for other embodiments of the present disclosure.

Moreover, the elongated body of the plug 400 may include at least a first keyway (may take the form of the front groove 452, and/or or the rear groove 454), and at least a first key (may take the form of the front rail 456, and/or the rear rail 458) that is configured to fit within the first keyway. These features may be symmetrical, but not necessarily so.

Any of the embodiments of the plug as discussed herein may be made from a suitably durable and rigid material such as iron, grey cast-iron, stainless steel, tool steel, etc. The initial blank of the plug may be cast and then rough and/or finish machined, etc.

INDUSTRIAL APPLICABILITY

In practice, various embodiments of the plug and/or the retaining mechanism may be supplied as a retrofit or replacement part in the field, or may be sold with a work implement, or a machine in an OEM (original equipment manufacturer) contexts.

While the arrangement is illustrated in connection with an electric rope shovel, the arrangement disclosed herein has universal applicability in various other types of machines commonly employ track systems, as opposed to wheels. The term "machine" may refer to any machine that performs some type of operation associated with an industry such as mining or construction, or any other industry known in the art. For example, the machine may be an excavator, wheel loader, cable shovel, or dragline or the like. Moreover, one or more implements may be connected to the machine. Such implements may be utilized for a variety of tasks, including, for example, lifting and loading.

Generally, the retention of adapter takes time because of material packs above it and prevents a maintenance team to follow proper adapter retention maintenance procedures during scheduled maintenance periods. More particularly, the present disclosure pertains to an electric rope shovel adapter that includes a ground engaging tool (GET) stackable retention plug. The stackable plug prevents excess material from being packed into the retention area and allows easy access to the retention during maintenance periods.

The aforementioned plug(s) may be able to help protect the retaining mechanism along a full depth range from a top position (such as shown in FIG. 6) to a bottom position (such as shown in FIG. 8) depending on the position of the retaining mechanism and/or wear of the top strap/leg of the adapter. Due to the clamp angle, it is desirable for the plug(s) to fit in an ever decreasing volume, while filling most of the volume. Also, it is desirable for the plug(s) to be easily accessed and removed regardless and the vertical position in the aperture.

Also, providing identical parts for the plugs allows only one part number to be used, decreasing logistical and manufacturing costs. The plug also fits over the existing locking cap 320, allowing the plug to be used as a retrofit to retaining mechanism already in the field.

As illustrated in FIGS. 8 thru 10, one more plugs are first lowered onto the wedge 302 and the cap 320 (see FIG. 9). At about the same time, the zip tie is threaded through each successive plug and its fastener receiving aperture. Then, the plug is slid to the left (see FIG. 10), locking the plugs together as the tab fits into the slot of the clamp. This process is repeated until the topmost plug is positioned near the top of the top adapter strap and shown in FIG. 8. Then, the zip tie is tightened until its head contacts the strut of the topmost plug. At this point, the plugs are secured to the wedge and will not fall out of the strap aperture. Removal may be achieved by unlocking or cutting the zip tie and reversing the horizontal and vertical steps just described to disengage one plug from the vertically adjacent plug.

Alternatively, after the zip tie is cut or unlocked, one or more plugs that are still horizontally interlocked may be lifted out as a subassembly, and then separated horizontally if desired, etc.

As used herein, the articles "a" and "an" are intended to include one or more items, and may be used interchangeably with "one or more." Where only one item is intended, the term "one" or similar language is used. Also, as used herein, the terms "has", "have", "having", "with" or the like are intended to be open-ended terms. Further, the phrase "based on" is intended to mean "based, at least in part, on" unless explicitly stated otherwise.

It will be apparent to those skilled in the art that various modifications and variations can be made to the embodiments of the apparatus and methods of assembly as discussed herein without departing from the scope or spirit of the invention(s). Other embodiments of this disclosure will be apparent to those skilled in the art from consideration of the specification and practice of the various embodiments disclosed herein. For example, some of the equipment may be constructed and function differently than what has been described herein and certain steps of any method may be omitted, performed in an order that is different than what has been specifically mentioned or in some cases performed simultaneously or in sub-steps. Furthermore, variations or modifications to certain aspects or features of various embodiments may be made to create further embodiments and features and aspects of various embodiments may be added to or substituted for other features or aspects of other embodiments in order to provide still further embodiments.

Accordingly, it is intended that the specification and examples be considered as exemplary only, with a true scope and spirit of the invention(s) being indicated by the following claims and their equivalents.

What is claimed is:

1. An adapter retention plug comprising:

an elongated body defining a right extremity, and a left extremity disposed along a longitudinal axis, the elongated body including a right vertical undercut forming void;

a left vertical undercut forming void; and a right L-shaped projection extending from a bottom surface of the elongated body, the right L-shaped projection being at least partially complementarily shaped to the right vertical undercut forming void to fit into the right vertical undercut forming void of an adjacent and identical adapter retention plug when the adapter retention plug is stacked on top of the adjacent and identical adapter retention plug.

2. The adapter retention plug of claim 1, wherein the left vertical undercut forming void extends from the left extremity, and the right vertical undercut forming void is disposed axially between a tab formed at the right extremity and the left vertical undercut forming void.

3. The adapter retention plug of claim 1, wherein the elongated body further defines a fastener receiving aperture that includes a strut that splits the fastener receiving aperture into a front slot and a rear slot.

4. The adapter retention plug of claim 3, wherein the elongated body includes a top surface, the bottom surface, and the strut extends from the bottom surface but terminates short of the top surface.

5. The adapter retention plug of claim 4, wherein the elongated body includes a left L-shaped projection extending from the bottom surface, the left L-shaped projection being at least partially complementarily shaped to the left vertical undercut forming void to fit into the left vertical undercut forming void of the adjacent adapter retention plug when the adapter retention plug is stacked on top of the adjacent adapter retention plug.

6. The adapter retention plug of claim 5, wherein the elongated body includes a right L-shaped projection and the left L-shaped projection simultaneously fit into the right vertical undercut forming void and the left vertical undercut forming void, respectively, when the adapter retention plug is stacked on top of the adjacent adapter retention plug.

7. The adapter retention plug of claim 6, wherein the right L-shaped projection includes a right angled vertical member.

8. The adapter retention plug of claim 1, wherein the elongated body includes a top rib, and a bottom rib that extend from the tab.

9. The adapter retention plug of claim 4, wherein the elongated body defines a front groove that extends vertically from the top surface and axially from the left extremity to the right extremity, and a rear groove that extends vertically from the top surface and axially from the left extremity to the right extremity.

10. The adapter retention plug of claim 4, wherein the elongated body includes a front rail or a rear rail that extends from the bottom surface, and the front rail or the rear rail includes a pry slot including an angled pry surface.

11. The adapter retention plug of claim 4, wherein the elongated body includes a convex arcuate surface that forms the left extremity, and that is drafted to enlarge axially from the top surface toward the bottom surface.

12. The adapter retention plug of claim 4, wherein the elongated body includes a planar surface that is disposed proximate to the right extremity, and that is drafted to decrease axially from the top surface toward the bottom surface.

13. An adapter retention plug comprising:

an elongated body defining a right extremity, and a left extremity disposed along a longitudinal axis, the elongated body including at least a first vertical undercut forming void;

a tab extending axially defining the right extremity; and at least one L-shaped projection that is configured to at least complementarily fit into the at least first vertical undercut forming void of an adjacent and identical adapter retention plug.

14. The adapter retention plug of claim 13, wherein the elongated body includes a fastener receiving aperture including a strut disposed in the fastener receiving aperture.

15. The adapter retention plug of claim 14, further comprising at least a second vertical undercut forming void, and the fastener receiving aperture is disposed axially between the first and the second vertical undercut forming voids.

16. The adapter retention plug of claim 13, wherein the elongated body includes at least a first keyway, and at least a first key that is configured to fit within the first keyway of the adjacent and identical adapter retention plug.

* * * * *